United States Patent [19]

Bass

[11] Patent Number: 4,473,026

[45] Date of Patent: Sep. 25, 1984

[54] FISHING BOAT

[76] Inventor: Robert T. Bass, 4375 Lake Rd., Bay Point, Miami, Fla. 33137

[21] Appl. No.: 228,309

[22] Filed: Jan. 26, 1981

[51] Int. Cl.[3] ..... B63B 35/14

[52] U.S. Cl. ..... 114/255; 114/56

[58] Field of Search ..... 9/1.1, 1.7, 1,5, 6 P, 9/6 W, 6 M, 7; 114/56-63, 71, 255, 355-358, 361, 364; D12/315, 318

[56] References Cited

U.S. PATENT DOCUMENTS

| | | | |
|---|---|---|---|
| D. 219,556 | 12/1970 | Keenan | D12/315 |
| D. 219,891 | 2/1971 | Cargile | D12/315 |
| 1,481,548 | 1/1924 | Gongaware | 9/1.5 |
| 3,039,417 | 6/1962 | Hoffberg | 114/71 |
| 3,174,452 | 3/1965 | Rickborn | 9/1.1 |
| 3,859,681 | 1/1975 | McVay et al. | 9/1.1 |

OTHER PUBLICATIONS

"Wallaby, A Fisherman Cruiser", *Yachting,* May 1950, p. 43.

*Primary Examiner*—Trygve M. Blix
*Assistant Examiner*—Jesûs D. Sotelo
*Attorney, Agent, or Firm*—Michael Ebert

[57] ABSTRACT

A low-profile fishing boat having a forward cabin in the bow covered by a foredeck whose level is about the same as the hull sheer line, the foredeck terminating at the bulkhead of the cabin. A bow rail is secured to the boundary of the foredeck and a center control console is mounted on the foredeck at a position thereon displaced from the bow rail to create a walk-around passage. The cabin bulkhead has a center door flanked on either side by steps leading from the walk-around passage on the foredeck to the sole of a rear cockpit, whereby a pilot stationed before the center console has good visibility in all directions and has ready access to both the cockpit and the bow for carrying out docking and anchoring stations. The complete walk-around capability of this boat is advantageous in fishing to both pilot and passengers.

8 Claims, 3 Drawing Figures

FISHING BOAT

BACKGROUND OF INVENTION

This invention relates generally to motorized sports boats, and more particularly to a low-profile fishing boat whose design is such to fully exploit the available space in a manner which renders the facilities thereon more effective and efficient for their intended purpose.

As used herein, the term "motorized sports boat" is intended to cover a boat which includes a cabin and has a length in the range of about 20 to 50 feet. Though a boat of this type is especially designed for sport fishing, it may be used for diving, skiing and other water sports. Sports boats of relatively small length may be powered by outboard motors, but in larger lengths use in generally made of inboard motors and diesel engines.

The qualifying term "low-profile" refers to a motorized sports boat whose cabin has a height that is roughly at the level of the sheer line of the boat hull, this being the line made by the upper edge of the hull. Thus in a low-profile boat, the foredeck over the cabin is at about the same level as the sheer line or slightly raised thereabove. The concern of the present invention is with low-profile, motorized sports boats.

The typical low-profile sports boat, such as the "Tiara Pursuit" manufactured by S2 Yachts, Inc., of Holland, Mich., includes a forward cabin which affords a protected living and storage area, the boundary of the foredeck covering the cabin being provided with a bow rail. Also included is an aft cockpit having a depressed deck or sole from which one may fish, the cockpit also being usable to stow fishing gear and other equipment.

In a boat of this low-profile type, interposed between the forward cabin and the aft cockpit is a control station which houses compasses as well as radio and electronic navigation equipment, the control panel being provided with all necessary steering and speed controls from which one may operate the boat from an adjacent pilot seat. Because the control station in a small boat effectively blocks the foredeck, access thereto from the cockpit is difficult and the foredeck space is often wasted or under-utilized.

In the "Tiara" boat, the control station is next to one side of the boat and secured to the cabin bulkhead; but in many sports boats, the control station is centered and freestanding, this arrangement being usually referred to as a center console. Boats with center consoles are manufactured by MAKO MARINE of Pompano Beach Fla., and by other boat makers. The advantage of a center console is that it permits piloting from the center with equal visibility on either side thereof. Also, it makes possible a complete walk-around capability, this being desirable in a fishing craft.

In existing embodiments of low-profile fishing craft, whether the control station is on one side or centered, because it is situated below the foredeck level and is at about the same level as the depressed deck or sole of the cockpit, visibility from this station is restricted and leaves much to be desired in other respects. Moreover, since the door to the foreward cabin is normally centered, when the boat incorporates a center console, this creates problems with cabin door placement and access.

In a high-profile boat, this drawback may be overcome by installing controls in a flybridge on top of the raised deck. In the case of low-profile boats, it is sometimes the practice to erect a so-called Tuna-Tower above the control station and to equip this tower with a duplicate set of steering and speed controls. A Tuna-Tower arrangement of this type is found in the "Dusky 25" diesel-powered, low-profile boat manufactured by Dusky Marine, Inc. of Dania, Fla.

While in a low-profile boat, an elevated Tuna-Tower gives the pilot enhanced visibility in all directions, it not only adds materially to the weight of the boat and to construction costs, but such towers are difficult to climb and represent a hazard in rough weather. Moreover, a pilot stationed on a Tuna-Tower does not have easy access to either the cockpit or the foredeck for purposes of fishing or to carry out docking and anchoring operations. One must bear in mind that in a small fishing boat, the pilot's function is usually not limited to navigation, for he often constitutes the entire working staff and must therefore be able to reach any quarter of the boat without encountering obstacles.

The most pertinent reference uncovered in a prior art search is the patent to McVay, U.S. Pat. No. 3,859,681, which discloses an emergency boat having a raised center console and a walkway on either side thereof with a bow cockpit provided at the forward end of the boat, so that a single operator stationed at the console can see over the bow, the stern and on both sides of the boat. The significant distinctions between the present invention and the McVay arrangement will become apparent when reading the description to follow.

Also found in the search are the following prior art references:

U.S. Pat. No. 1,481,548 to Gongaware;
U.S. Pat. No. 2,096,167 to Farrugia;
U.S. Pat. No. 2,288,490 to Scott-Paine;
U.S. Pat. No. 3,859,681 to McVay et al.
U.S. Pat. No. Des. 219,556 to Keenan
U.S. Pat. No. Des. 242,911 Kurose

SUMMARY OF INVENTION

In view of the foregoing, the main object of this invention is to provide a low-profile sports boat having a center console that is mounted on the foredeck, thereby enhancing visibility and making better use of the available space.

More particularly, it is an object of the invention to provide a low-profile sports boat with a center console mounted on a foredeck above the forward cabin to afford a complete walk-around capability and giving the pilot easy access to both bow and cockpit.

A significant feature of the invention resides in the fact that with a captain's bench seat on the foredeck, this makes it possible to provide a higher and more accessible cabin door. And because the center console is on the foredeck level rather than being down in the cockpit, improved visibility is gained without the added weight, expense and practical limitations of a Tuna-Tower.

Also an object of the invention is to provide a raised center console arrangement in a low-profile sports boat in which the pilot and cockpit areas are protected from wind and spray.

Briefly stated, these objects are attained in a low-profile sports boat having a forward cabin in the bow covered by a foredeck whose level is substantially the same as the sheer line of the hull, the foredeck terminating at the bulkhead of the cabin. A bow rail is secured to the boundary of the foredeck and a center control console is mounted on the foredeck at a position thereon displaced from the bow rail to create a walk-around passage.

The cabin bulkhead has a center door flanked on either side by steps leading from the walk-around passage on the foredeck to the sole of a rear cockpit whereby a pilot seated before the center console has excellent and unobstructed visibility in all directions and has ready access to the cockpit and the bow for carrying out docking and anchoring actions. The complete walk-around capability of this boat is of great advantage in fishing to the passengers as well as to the pilot.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
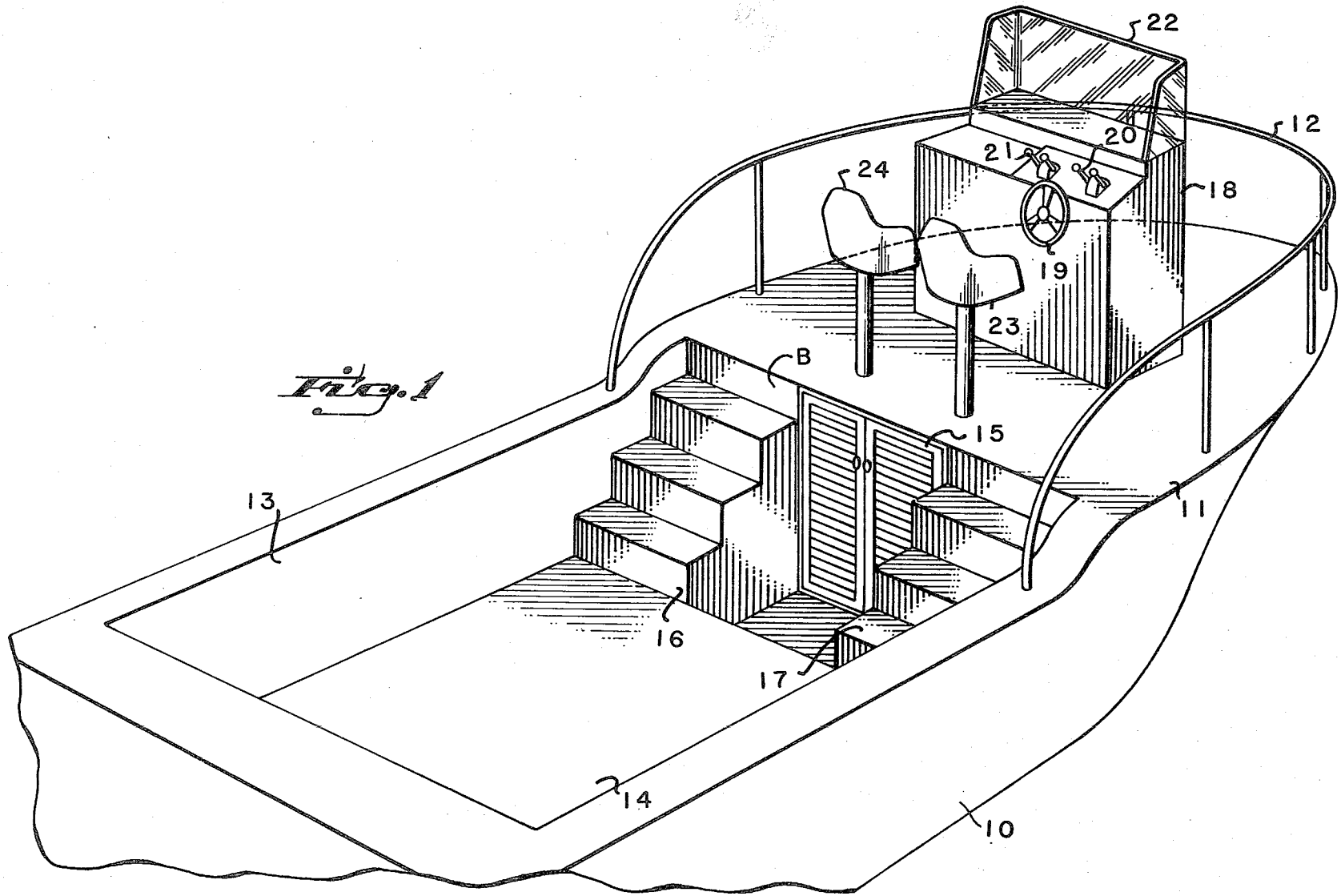
FIG. 1 is a perspective view of one embodiment of a sports boat in accordance with the invention.

First Embodiment:

Referring now to FIG. 1, there is shown a low-profile boat having a hull 10 and a forward cabin in the bow covered by a foredeck 11 whose level is flush with the sheer line of the boat, the foredeck terminating in the bulkhead B of the cabin. The illustrated boat is idealized; for in practice the foredeck may be slightly lower or higher than the sheer line, depending on the cabin structure. Thus with a cabin whose height is somewhat above the sheer line, the foredeck may be banked by a walkway at the sheer line level. Secured along the periphery of the foredeck is a protective bow rail 12.

The remaining hull area is occupied by a rear cockpit 13 having a depressed deck or sole 14. The cabin bulkhead is provided at its center with a pair of access doors 15. Flanking doors 15 on either side thereof are stairs 16 and 17 leading from the cockpit sole 14 to the walkway on foredeck 11.

Mounted on foredeck 11 away from the bow on either side thereof is a center control console 18 provided with a steering wheel 19 and speed and direction controls 20 and 21. The console is fitted with a transparent wind and spray shield 22. A pair of pilot seats 23 and 24 are stationed in front of the console in the pilot zone on the foredeck.

Since the center console is not at the level of the depressed cockpit sole but rests on the foredeck, the pilot has excellent visibility fore and aft, and on either side of the boat. The pilot has easy access to the cockpit by way of the stairs and to the bow of the boat by way of the walk-around passage. Passengers in the cockpit have unobstructed access to the cabin and to the foredeck. And because the console is not in the cockpit area, significantly more cockpit space is available to the passengers than in conventional sports boat designs.

Figure 2:
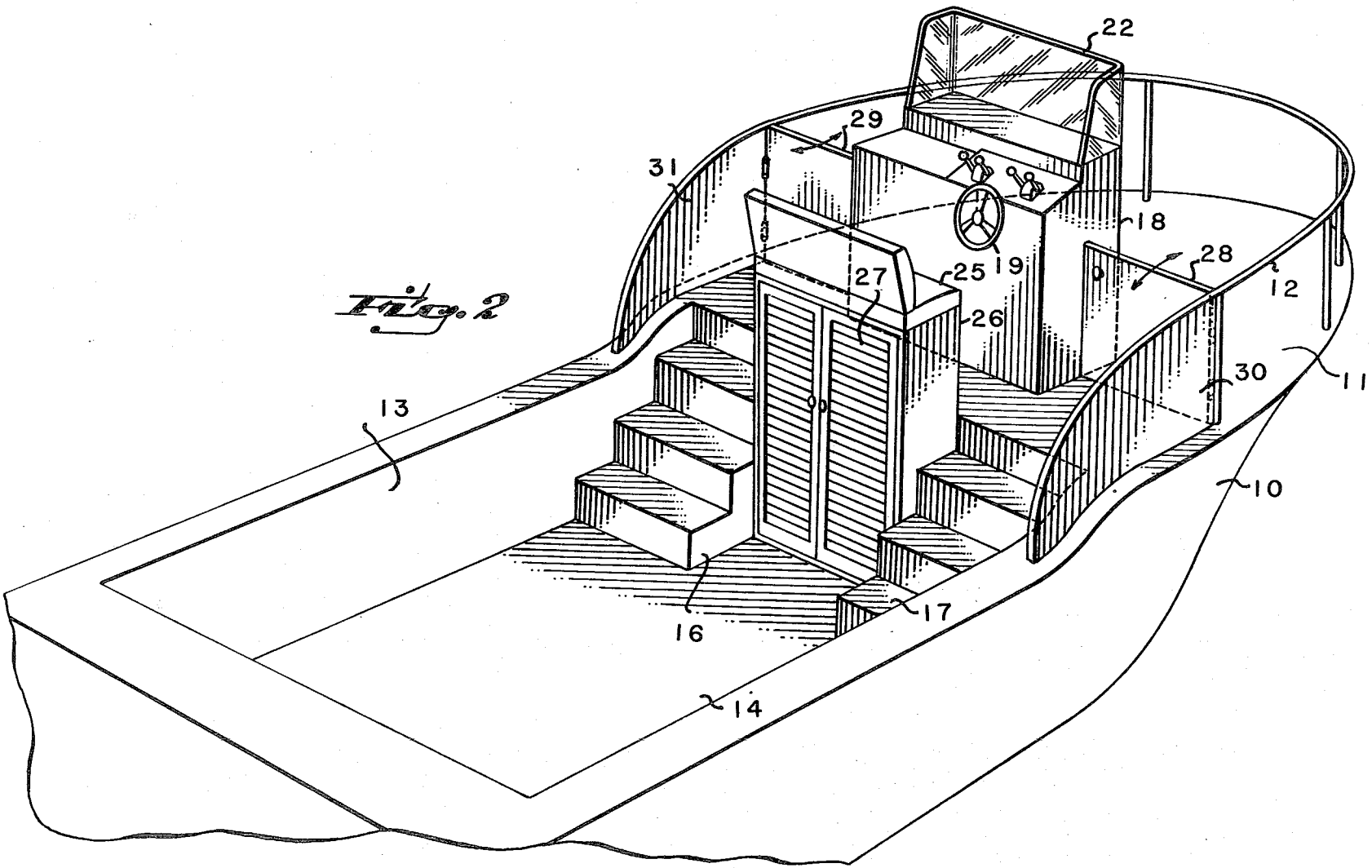
FIG. 2 is a perspective view of a second embodiment.
Figure 3:
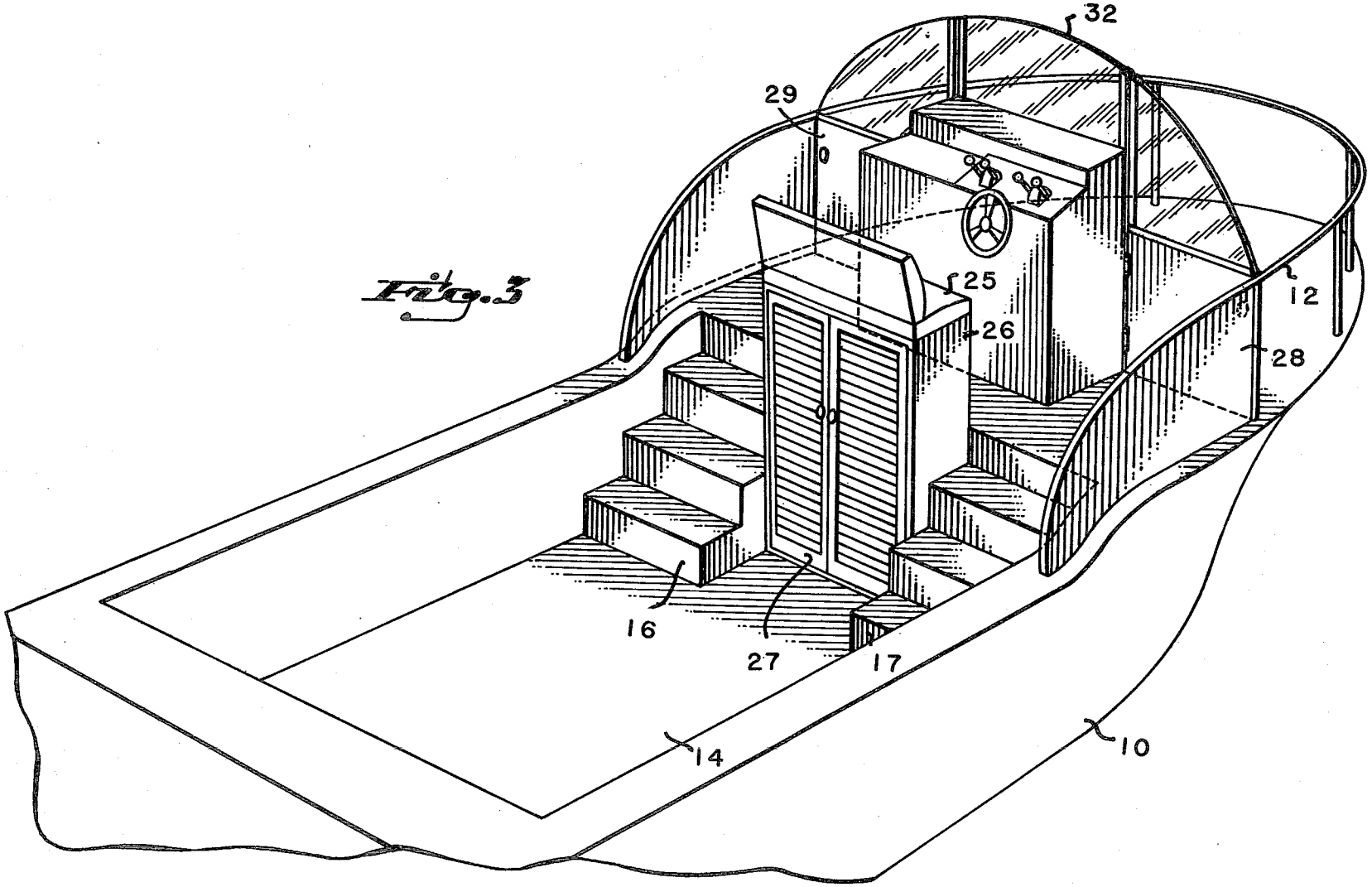
FIG. 3 is a perspective view of a third embodiment.

Second Embodiment:

In the arrangement shown in FIG. 2, instead of pilot seats, the boat is provided with a bench-type captain's seat 25 which is positioned on top of a tall closet 26 formed in front of the bulkhead which rises above the foredeck and is provided with doors 27 leading into the foreward cabin through a bulkhead opening. This makes it possible to use higher doors than in the arrangement shown in FIG. 1, giving more convenient entry into the cabin.

The bow area of the foredeck is segregated from the pilot zone in front of center console 18 by a pair of hinged gates 28 and 29 which extend between opposite sides of the console and bow rail 12. The bow rail has contoured side panels 30 and 31 fitted therein, the gates being hinged thereon. These side panels, in combination with gates 28 and 29, normally function as wind and spray shields, and when open afford ready access to the bow.

Third Embodiment:

This arrangement is essentially the same as that shown in FIG. 2, except that in place of a windshield which protects only the console, there is provided a large arcuate shield 32 which extends the full width of the hull to enlarge the degree of protection. Windshield 32 is articulated so that the portions thereof over gates 28 and 29 swing with these gates.

While there have been shown and described preferred embodiments of a fishing boat in accordance with the invention, it will be appreciated that many changes and modifications may be made therein without, however, departing from the essential spirit thereof.

I claim:

1. A low-profile motorized sports boat comprising:

A a hull having a forward cabin fitted in the bow thereof and covered by a generally flat foredeck whose level is substantially equal to that of the sheer line of the hull at the upper edge thereof, the foredeck terminating at the bulkhead of the cabin;

B a bow rail secured to the boundary of the foredeck;

C a center control console which constitutes the sole control means for the boat mounted on the foredeck at a position displaced from the bow rail to define in the space between the bow rail and the console a walk-around passage which surrounds said console, whereby a pilot navigating the boat from said console has added height as well as excellent visibility fore and aft and on either side of the boat;

D a cockpit defined between the bulkhead of the cabin and the stern of the boat, said cockpit having a sole below the sheer line of the hull at a level such that an adult standing on the sole can see above the foredeck, the low-profile arrangement being such that had the control console been placed against the bulkhead, the pilot would then be in the cockpit and have limited visibility;

E stairs leading from the sole to the walk-around passage on the foredeck to connect the cockpit to the foredeck whereby passengers in the cockpit have unobstructed access to the foredeck and to the walk-around passage thereon; and F at least one seat on the foredeck in front of the console.

2. A boat as set forth in claim 1, wherein said center console is provided with a windshield.

3. A boat as set forth in claim 1, further including a center door on the cabin bulkhead.

4. A boat as set forth in claim 3, wherein said stairs are placed on either side of the door.

5. A boat as set forth in claim 4, further including a pair of hinged gates between opposite sides of the console and the bow rail.

6. A boat as set forth in claim 5, further including an arcuate transparent shield behind the console and extending over the gates, said shield being articulated so that the sections thereof over the gates swing therewith.

7. A boat as set forth in claim 5, further including panels mounted under the bow rails on either side of the hull, each panel having its leading edge coincident with the associated gate.

8. A boat as set forth in claim 1, wherein a tall closet is disposed in front of the cabin bulkhead at the center thereof, the top of the closet being raised above the foredeck, said closet having doors providing access to the cabin, and wherein said at least one seat is a captain's seat on the top of the closet.

* * * * *

US004473026C1

(12) EX PARTE REEXAMINATION CERTIFICATE (5077th)

United States Patent
Bass

(10) Number: US 4,473,026 C1
(45) Certificate Issued: Mar. 8, 2005

(54) FISHING BOAT

(75) Inventor: Robert T. Bass, 4375 Lake Rd., Bay Point, Miami, FL (US) 33137

(73) Assignee: Robert T. Bass, Miami, FL (US)

Reexamination Request:
No. 90/004,127, Jan. 31, 1996
No. 90/004,403, Oct. 3, 1996

Reexamination Certificate for:

| | |
|---|---|
| Patent No.: | **4,473,026** |
| Issued: | **Sep. 25, 1984** |
| Appl. No.: | **06/228,309** |
| Filed: | **Jan. 26, 1981** |

(51) Int. Cl.[7] ..... B63B 35/14
(52) U.S. Cl. ..... 114/255; 114/364; 114/382
(58) Field of Search ..... 114/56–63, 71, 114/255, 355, 358, 361, 362, 364; D12/315, 318

(56) References Cited

U.S. PATENT DOCUMENTS

D219,891 S 2/1971 Cargile

OTHER PUBLICATIONS

One page advertisement for Matthews "42" Double Cabin Boat published in Feb. 1956 *Rudder* Magazine and including cover page and table of contents page.
One page advertisement for Reinell B–2471 Boat published in May 1976 *Rudder* magazine and including cover page and table of contents page.
One page advertisement for Wellcraft 24' boat published in Dec. 1977 *Inland Sea* magazine and including cover page and table of contents page.
Eight page article entitled "The Cruisers 288 Villavee" published in Sep. 1978 boating magazine and including cover page and table of contents page.
Six page reprint from Sep. 1978 *Boating* magazine entitled "The Cruisers 288 Villavee", published prior to Jan. 1, 1980.
Six page brochure entitled "ChaletVee 260" published by Cruisers Mirro Marine Division, Mirro Corporation, published prior to Jan. 1, 1980.
One page article entitled "Fishing Vessel Designed For Engine Aft" (p. 11–C) published in Jun. 1976 *National Fisherman* magazine and including cover page.
Two page brochure entitled "*Cutter . . . It makes your dreams come true*" published by Cargile, Inc., published prior to Jan. 1, 1980.
*The Rudder Magazine*, Feb. 1956, vol. 72, No. 2, p. 2, one page of advertisement for "42" Flying Bridge Double Cabin by The Matthews Co., Ohio.
*The Rudder Magazine*, May 1976, vol. 92, No. 5, one page of advertisement for "B–2471", by Reinell, Illinois.
*Inland Sea Magazine*, Dec. 1977, one page of advertisement for "24' Skipjack" by Wellcraft, Florida.
*Boating Magazine*, Sep. 1978, vol. 44, No. 3, "The Cruisers 288 Villavee", by Larry Kean and Dick Rath, pp. 59–97.
Reprint from *Boating Magazine*, Sep. 1978, "The Cruise 288 Villavee", by Larry Kean and Dick Rath, Ziff–Davis Publishing Company.
"Chalet Vee 260", Cruisers Mirro Marine Division, Mirro Corporation, Oconto, Wisconsin.
Three–page brochure by Cargile, Inc. entitled "The New Cutter 30" published prior to Jan. 1, 1980.
Magazine article published Jun. 1976 in National Fisherman, p. 11–C and cover page of said magazine.
Two–page brochure by Cargile, Inc. entitled "CUTTER . . . It makes your dreams come true", published prior to Jan. 1, 1980.

*Primary Examiner*—Jesus D. Sotelo

(57) ABSTRACT

A low-profile fishing boat having a forward cabin in the bow covered by a foredeck whose level is about the same as the hull sheer line, the foredeck terminating at the bulkhead of the cabin. A bow rail is secured to the boundary of the foredeck and a center control console is mounted on the foredeck at a position thereon displaced from the bow rail to create a walk-around passage. The cabin bulkhead has a center door flanked on either side by steps leading from the walk-around passage on the foredeck to the sole of a rear cockpit, whereby a pilot stationed before the center console has good visibility in all directions and has ready access to both the cockpit and the bow for carrying out docking and anchoring stations. The complete walk-around capability of this boat is advantageous in fishing to both pilot and passengers.

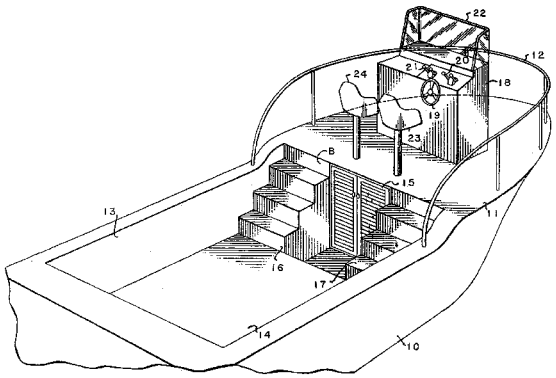

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5–8 is confirmed.

Claims 1–4 are cancelled.

* * * * *